United States Patent [19]

Key et al.

[11] 4,102,057

[45] Jul. 25, 1978

[54] MANUFACTURE OF DETERGENT COMPOSITIONS

[75] Inventors: Michael David Key, Rotterdam, Netherlands; William Gordon McNee, Chester, England

[73] Assignee: Lever Brothers Company, New York, N.Y.

[21] Appl. No.: 774,070

[22] Filed: Mar. 3, 1977

[30] Foreign Application Priority Data

Mar. 5, 1976 [GB] United Kingdom ..... 8935/76

[51] Int. Cl.[2] ..... F26B 3/08

[52] U.S. Cl. ..... 34/10

[58] Field of Search ..... 34/9, 10

[56] References Cited

U.S. PATENT DOCUMENTS 2,941,947 6/1960 Schauer ..... 34/10 X

*Primary Examiner*—John J. Camby

*Attorney, Agent, or Firm*—Melvin H. Kurtz

[57] ABSTRACT

Spray-dried fabric washing detergent powders based on nonionic surfactants are prepared by a process involving the step of injecting a phosphoric acid ester into the high pressure line carrying slurry to the spray-drying tower. The phosphoric acid ester is dissolved or dispersed in a nonionic surfactant such as a long chain alcohol ethoxylate and injected into the pressurized slurry either using a venturi effect or by being pressurized to a higher pressure.

5 Claims, No Drawings

MANUFACTURE OF DETERGENT COMPOSITIONS

This invention relates to the manufacture of detergent compositions.

Alkyl phosphates are becoming increasingly common components of detergent powders with the arrival on the market of products in which the surface-active agent is predominantly nonionic. The reason for this is that alkyl phosphates exhibit a foam-inhibiting effect when used in conjunction with nonionic surfactants and the resulting product is eminently suitable for use in automatic front-loading washing machines. We have been searching for a satisfactory method of incorporating alkyl phosphate into our detergent powders.

The conventional way of manufacturing detergent powders is to prepare an aqueous slurry, known as a crutcher slurry, of the components which are not heat sensitive to pressurise the slurry and to conduct it in a high pressure line to the nozzles of a countercurrent spray-drying tower. The heat-sensitive ingredients are added to the spray-dried powder which emerges from the base of the spray-drying tower in a step normally referred to as dry-dosing.

Crutcher slurries which contain large amounts of nonionic surfactant are often rather difficult to handle in that they tend to separate into two phases — this can lead to an inhomogeneous slurry reaching the nozzles of the spray-drying tower, which not only leads to an unsatisfactory product but can also introduce a fire hazard. In order to overcome this problem we have developed a process which includes the step of injecting a proportion of the nonionic surfactant directly into the high pressure line which carries the slurry. This process has proved satisfactory now for some considerable time.

We have now discovered that alkyl phosphate can be dissolved in nonionic surfactant and the resulting solution can be injected directly into the high pressure line.

Accordingly, the present invention provides a process for incorporating alkyl phosphate into a detergent composition which comprises injecting a solution of the alkyl phosphate in a nonionic surfactant into a pressurised crutcher slurry and spray-drying the resultant mixture.

When using alkyl phosphate for foam-inhibition in detergent formulations containing nonionic surfactants as the predominant or even sole detergent-active substance, it will be satisfactory if the level used in the process is sufficient to provide from 0.5 to 2.0% by weight in the final formulation, although for other uses of alkyl phosphate different amounts will be used.

Although very little nonionic surfactant is needed to solubilise most alkyl phosphates, it will normally be necessary to use at least 3%, preferably 3–10%, by weight of the final formulation to justify the expense of arranging apparatus for the direct injection. Thus the ratio alkyl phosphate : nonionic in the mixture which is injected can be from about 1:15 to about 1:1½.

Dissolution of the alkyl phosphate may be achieved by using a nonionic surfactant which is liquid at room temperature or one which can be liquified at crutcher slurry temperatures which may be up to about 70° C.

The crutcher slurry can contain conventional ingredients in conventional amounts. For example it can contain nonionic surfactants in amounts of from 2–15% by weight, anionic surfactants including soaps in amounts of up to 5% by weight, builders such as sodium tripolyphosphate, sodium carbonate, sodium silicate or any one or more of the numerous organic builders which have been suggested in response to the phosphorus-induced eutrophication problem and such minor ingredients as anti-redeposition aids, antioxidants, fillers such as sodium sulphate, fluorescers and optical brightening agents. Any one of these components may also be dry-dosed into the formulation.

The nonionic surfactant for use in the compositions of the invention will be an alkoxylated long chain alcohol. We have found these nonionic surfactants most suitable for use in fabric washing powders, having regard to the often conflicting requirements of good detergency, safe biological properties and ease of processing.

The alcohols from which the nonionic surfactants can be prepared can be primary or secondary alcohols containing straight or branched carbon chains. The number of carbon atoms will generally be from about 7 to about 24, preferably from about 8 to 18 and most preferably from about 12 to 16. These alcohols may be the so-called synthetic alcohols made by the well known Ziegler or Oxo processes, or the so-called "natural alcohols".

The alkoxylation reaction will be carried out by conventional means, generally using ethylene oxide or propylene oxide. The degree of ethoxylation can vary widely both from one hydrophobe to another and even when using a single hydrophobe. Thus ethylene oxide chains containing as few as 1 and more than 20 ethylene oxide units are quite often found in nonionic surfactants and will be applicable here.

The choice of carbon chain length of the hydrophobe and the chain length of the hydrophilic alkoxy chain is largely determined by the detergent properties required of the molecule. The relationship between the chain length of the hydrophobic part of the molecule and that of the hydrophilic part can be expressed numerically as the hydrophilic-lipophilic balance (HLB). An approximate way of determining the HLB is to use the expression $$\text{HLB} = \frac{\text{Wt percentage of ethylene oxide}}{5}.$$

Nonionic surfactants which are suitable for use in heavy duty fabric washing powders generally have an HLB in the range up to 13, although HLBs outside this range are not excluded.

An additional factor in the choice of nonionic surfactant is that alcohols containing both short carbon and short ethoxylate chain lengths are relatively low boiling and can volatilise under the conditions prevailing in a spray-drying tower.

Hence alcohols containing less than about 8 carbon atoms will not normally be chosen unless their ethoxy chains contain at least about 8 ethylene oxide units.

Preferred alcohol ethoxylates for use in this invention are derived from the following series.

Tergitols (Trade Mark) which are a series of ethoxylates of secondary alcohols sold by the Union Carbide Corporation, especially Tergitol 15-S-7, 15-S-9, 15-S-12 and 15-S-15 which are ethoxylates of a mixture of C11-15 alcohols and Tergitols 45-S-7, 45-S-15 which are ethoxylates of a mixture of C14 and C15 alcohols, the degree of ethoxylation being shown by the postscript.

Ethoxylates of primary alcohols made by the Oxo process and containing about 20% of alpha branched material sold by Shell Chemicals Ltd., Dobanols (Trade Mark) and Shell Chemicals Inc., Neodols (Trade Mark), especially Dobanol and Neodol 25-7, 25-9, 25-12 and 25-15 which are ethoxylates of a mixture of $C_{12}$–$C_{15}$ alcohols and Dobanol 45-7, 45-9, 25-12 and 25-15 which are ethoxylates of a mixture of $C_{14-15}$ alcohols.

Ukanils (Trade Mark) which are a series of ethoxylates of Oxo alcohols containing about 40% of alpha alkyl branched material manufactured by ethoxylation of, for example, Acropols (Trade Mark) especially Acropol 35 which is a $C_{13}$–$C_{15}$ alcohol mixture.

Synperonics (Trade Mark), a series of ethoxylates of alcohols containing 45–55% of alkyl branching, mostly methyl branching, sold by Imperial Chemical Industries Limited, especially those based on a $C_{13-15}$ mixture of alcohols and ethoxylated to 7, 9, 11 and 15 units of ethylene oxide.

Alfols (Trade Mark) which are ethoxylates of primary Ziegler alcohols derived by oxidative polymerisation of ethylene, manufactured by Conoco-Condea, especially Alfol 12/14-7, 12/14-9, 12/14-12, 12/14-15 and Alfol 14/12-7, 14/12-9, 14/12-12, 14/12-15 which are ethoxylates of mixtures of $C_{12}$ and $C_{14}$ alcohols.

Ethoxylates of primary Oxo alcohols about 50% branched, mainly $\alpha$ methyl sometimes called Lials (Trade Mark) produced from olefins manufactured by Liquichemica.

Lutensols (Trade Mark) which are a series of $C_{13-15}$ alcohol ethoxylates prepared by the "Oxo" process from an olefin produced by the polymerisation of ethylene, manufactured by Badische Anilin und Soda Fabrik GmbH, especially Lutensol A08 and 12.

The required HLB can be achieved not only by selecting the carbon chain length of the hydrophobe and the length of the alkyleneoxy chain in a single or substantially single material (because of the nature of their process of production, all nonionic surfactants which are spoken of as if they were single substances are in fact mixtures). It can also be achieved by deliberately taking two "nonionic substances" of widely differing HLBs and mixing them. This approach is described in our own British patent application No. 16641/76, Netherlands patent application No. 7413522 and in Netherlands patent application No. 7406003. It is also possible to obtain the required HLB by "stripping" some chain lengths from a nonionic surfactant mixture as described in patent applications based on U.S. Ser. No. 453,464 filed on Mar. 21, 1974, now abandoned, and U.S. Pat. No. 3,682,849.

The apparatus necessary for operating the process of the invention is simple. The normal spray-drying process for making detergents requires a spray-drying tower, usually a counter-current one, in which a slurry of detergent-containing ingredients is pressurised in a pressurising pump and is fed to the spraying nozzles of the tower via a main high pressure line. The modification which the present invention requires is that an auxiliary slurry-making crutcher is provided, the auxiliary crutcher being connected to the high pressure side of the pressurising pump just described. It may be possible to arrange that material from this auxiliary crutcher is sucked into the main high pressure line as a result of a venturi effect. Alternatively an auxiliary pressurising pump may be provided between the auxiliary crutcher and the main high pressure line. Those skilled in the art of chemical engineering will find it a simple matter to design suitable apparatus.

The spray-dried support grains in accordance with the present invention contain 0.05 to 1.5% of a phosphate ester, 30 to 70% of an alkaline inorganic builder salt, 2 to 10% of an alkali metal silicate, and 10 to 50% of an alkali metal sulphate. A conventional spray-drying process as described above is used for the formation of support grains having a density of 300 to 500 g/liter.

Alkyl phosphates in accordance with the present invention have the following general formulae

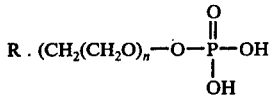

or

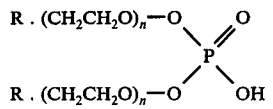

where R is a linear or branched alkyl or alkenyl group having 12 to 20 carbon atoms and $n$ is 0 or an integer from 1–15.

The alkyl phosphates may be a mixture of various esters, and may be neutralised with a base such as sodium hydroxide to form the corresponding salts, which can also be used. In the present invention, the term "alkyl phosphate" is used to designate acid monoalkyl and dialkyl, and ethoxylated monoalkyl and dialkyl, phosphates and their alkali metal salts including sodium and potassium salts or ammonium and substituted ammonium salts.

Commercially obtainable forms of alkyl phosphates may contain small quantities of condensed phosphates, such as pyrophosphates, polyphosphates, and monoalkyl and dialkyl orthophosphates. Small quantities, e.g. up to 5%, of the trialkyl phosphates may also be formed during the production of the monoalkyl and dialkyl phosphates.

Typical acid alkyl phosphates that are suitable for use in the invention are acid monolauryl monopalmityl or dipalmityl phosphate, acid monostearyl or distearyl phosphate, and their monosodium or disodium salts.

The acid alkyl phosphates are produced by reaction of a primary aliphatic alcohol having 12 to 20 carbon atoms, preferably 12 to 18 carbon atoms, and phosphoric acid. Reactions of this type are known in themselves. Secondary saturated aliphatic alcohols having the required number of carbon atoms are allowed to react with a phosphoric acid to form branched phosphate esters.

Acid ethoxylated alkyl or alkenyl phosphates are produced from compounds having the formula $R(OC_2H_4)_nOH$, where R has 12 to 20 carbon atoms, preferably 12 to 18 carbon atoms, and $n$ = 1 to 15, preferably 1 to 10, by known methods of phosphate formation. Examples of materials of this type are the coconut fatty alcohol adducts with 6 to 10 moles of ethylene oxide, oleyl alcohol adducts with 10 to 20 moles of ethylene oxide, tridecyl alcohol adducts with 10 to 20 moles of ethylene oxide, and stearyl alcohol adducts with 10 to 30 moles of ethylene oxide.

Examples of phosphating agents that are used for the production of phosphate esters are polyphosphoric acid and orthophosphoric acid. Other agents and mixtures of agents may be used. Corresponding methods for the production of the phosphate esters in accordance with the present invention are described in British Pat. No. 1159643.

The invention will be further described in the following example.

EXAMPLE

A crutcher slurry was prepared by adding the following components to 100 parts of water heated to 65° C.

| | Parts by weight |
|---|---|
| Ethoxylated Alcohol (Tergitol 15-S-9)* | 8.0 |
| Sodium tripolyphosphate | 40.0 |
| Sodium silicate 38–40° Be) | 15.0 |
| Sodium sulphate | 29.0 |
| Sodium carboxymethyl cellulose | 1.0 |

*Tergitol 15-S-9 (Registered Trade Mark) is a $C_{12-15}$ random secondary alcohol ethoxylated with an average of 9 moles ethylene oxide per mole of alcohol. It is available from the Union Carbide Corporation.

*Alf 5 (Registered Trade Mark) is a phosphate ester containing 70–85% by weight of the mono $C_{16}$ alkyl ester of phosphoric acid. It is available from Lankro Chemicals Ltd.

The slurry was then pumped continuously into a pressure pipe leading to the atomization nozzles of a Ballestra counter-current spray-drying tower. The pressure in the pipe was maintained between 700–800 psi.

A solution containing 5.5 parts by weight of Tergitol 15-S-9 and 1.5 parts by weight of Alf 5* was prepared and injected into the pressure pipe, from where the combined components of the crutcher slurry and the solution passed through the atomization nozzles and emerged at the bottom of the spray-drying tower as a spray-dried powder, which was dry-dosed in the conventional manner.

What is claimed is:

1. In a spray-drying process for manufacturing a fabric washing detergent powder which contains an alkoxylated alcohol nonionic surfactant and a $C_{12-20}$ mono- or dialkyl phosphate having the general formula

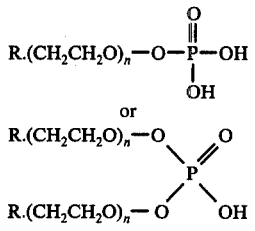

wherein R is a $C_{12-20}$ alkyl group and $n$ is 0 or an integer from 1–15 wherein a main crutcher slurry of fabric washing powder components is pressurised, conveyed in a high pressure line to the nozzles of a spray-drying tower and spray-dried to a powder, the improvement which comprises dissolving or suspending the mono- or dialkyl ester of phosphoric acid in the nonionic surfactant and introducing the resultant solution or suspension into the high pressure line.

2. A process according to claim 1, wherein the alkyl phosphate is a $C_{16}$ alkyl ester of orthophosphoric acid.

3. A process according to claim 1, wherein the nonionic surfactant used for dissolving or dispersing the slurry comprises from 3 to 10% by weight of the spray-dried detergent powder.

4. A process according to claim 1, wherein the alkyl phosphate comprises from 0.5 to 2% by weight of the spray-dried detergent powder.

5. A process according to claim 1 wherein the weight ratio alkyl phosphate : nonionic surfactant is from 1:1½ to 15:1.

* * * * *